US008620199B2

(12) United States Patent
Kumagai

(10) Patent No.: US 8,620,199 B2
(45) Date of Patent: Dec. 31, 2013

(54) CLEANING BLADE, CLEANING DEVICE, PROCESS CARTRIDGE, IMAGE FORMING APPARATUS, AND HOLDER MEMBER

(75) Inventor: Naohiro Kumagai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 210 days.

(21) Appl. No.: 13/231,362

(22) Filed: Sep. 13, 2011

(65) Prior Publication Data

US 2012/0063827 A1 Mar. 15, 2012

(30) Foreign Application Priority Data

Sep. 15, 2010 (JP) ..... 2010-206540
Oct. 9, 2010 (JP) ..... 2010-229156

(51) Int. Cl.
*G03G 21/00* (2006.01)

(52) U.S. Cl.
USPC ..... 399/305

(58) Field of Classification Search
USPC ..... 399/350
See application file for complete search history.

(56) References Cited

U.S. PATENT DOCUMENTS

| | | | |
|---|---|---|---|
| 7,050,741 | B2 | 5/2006 | Koike et al. |
| 7,228,099 | B2 | 6/2007 | Shintani et al. |
| 7,386,257 | B2 | 6/2008 | Koike et al. |
| 7,430,377 | B2 | 9/2008 | Koike et al. |

FOREIGN PATENT DOCUMENTS

| | | |
|---|---|---|
| JP | 62-69270 | 4/1987 |
| JP | 2-73287 | 3/1990 |
| JP | 7-311526 | 11/1995 |
| JP | 9-185306 | 7/1997 |
| JP | 10-198243 | 7/1998 |
| JP | 2001-249591 | 9/2001 |
| JP | 2004-117918 | 4/2004 |
| JP | 2008-299064 | 12/2008 |

*Primary Examiner* — Quana M Grainger
(74) *Attorney, Agent, or Firm* — Oblon, Spivak, McClelland, Maier & Neustadt, L.L.P.

(57) ABSTRACT

A cleaning blade which is provided in a cleaning device that removes non-transferred toner remaining on an image carrier includes: a blade member in which an edge thereof is in contact with the image carrier over a longitudinal direction thereof; and a holder member that holds the blade member and has an L-shape in a cross-section that is perpendicular to the longitudinal direction. The holder member includes a supporting portion that cantilevers the blade member on a surface thereof such that the edge of the blade member protrudes toward the image carrier, and a bent portion that is connected to the supporting portion to form the L-shaped cross-section and is formed to have a lateral length that is shorter at least a lateral length at one end portion in the longitudinal direction thereof than at a middle portion thereof in the longitudinal direction.

9 Claims, 5 Drawing Sheets

CLEANING BLADE, CLEANING DEVICE, PROCESS CARTRIDGE, IMAGE FORMING APPARATUS, AND HOLDER MEMBER

CROSS-REFERENCE TO RELATED APPLICATIONS

The present application claims priority to and incorporates by reference the entire contents of Japanese Patent Application No. 2010-206540 filed in Japan on Sep. 15, 2010 and Japanese Patent Application No. 2010-229156 filed in Japan on Oct. 9, 2010.

BACKGROUND OF THE INVENTION

1. Field of the Invention

The present invention relates to a cleaning blade for cleaning a non-transferred toner on an image carrier such as a photosensitive element, a photosensitive belt, an intermediate transfer belt, or the like, which is formed in an image forming apparatus that uses an electro-photographic method, such as a copying machine, a printer, a facsimile, a multi-function peripheral (MFP) thereof, or the like. The present invention also relates to a cleaning device including the cleaning blade, a process cartridge, and an image forming apparatus each including the cleaning device, and a holder member of the cleaning blade.

2. Description of the Related Art

In the related art, in a cleaning device of an image forming apparatus such as a copying machine or a printer, a technique that uses a cleaning blade for cleaning a non-transferred toner remaining on an image carrier such as a photosensitive element or an intermediate transfer belt is known (for example, refer to Japanese Patent Application Laid-open No. 10-198243 and Japanese Patent Application Laid-open No. 2001-249591).

Specifically, non-transferred toner, remaining on an image carrier after a transfer process, is removed by a cleaning blade that is in contact with the image carrier. The cleaning blade is one in which a blade member formed of a rubber material, or the like, is held by a blade holder (holder member) formed of a metal material, or the like, by being cantilevered, and an edge of the blade member is in contact with the image carrier over an longitudinal direction thereof.

Japanese Patent Application Laid-open No. 10-198243 discloses a technique which aims to decrease the contact pressure of a blade member to a photosensitive element at both ends in the longitudinal direction thereof. According to the technique, an attachment surface of a blade holder to which the blade member is attached is formed so that both ends in the longitudinal direction thereof are set apart from the photosensitive element.

The cleaning blade of the related art is in contact with the image carrier so that frictional resistance acting on the blade member increases at the end portions thereof in the longitudinal direction as compared to the middle portion thereof in the longitudinal direction. Thus, the blade member may be rolled up or cause vibration that makes noises.

Specifically, because both ends of the blade member in the longitudinal direction take positions, on the image carrier, in a non-image forming region or at positions near the non-image forming region, the amount of non-transferred toner supplied to the blade member is also smaller at both ends in the longitudinal direction than at the middle portion in the longitudinal direction. When the amount of the toner (the non-transferred toner supplied to the blade member) disposed between the blade member and the image carrier is insufficient, the image carrier becomes nearly in direct contact with the blade member. Thus, the frictional resistance acting on the blade member increases, and the blade member may be rolled up or cause vibration to make noises. As above, in the cleaning blade of the related art, it is likely that the blade member is rolled up or causes vibration to make noises at the ends thereof in the longitudinal direction.

On the other hand, according to the technique disclosed in Japanese Patent Application Laid-open No. 10-198243 described above, the blade member that follows the shape of the blade holder is attached to the blade holder so as to be apart from the photosensitive element at both ends in the longitudinal direction thereof. Thus, steps are formed at both of the end portions of the edge which is in contact with the photosensitive element, whereby insufficient cleaning is likely to occur at the positions of the end portions.

SUMMARY OF THE INVENTION

It is an object of the present invention to at least partially solve the problems in the conventional technology.

According to an aspect of the present invention, there is provided a cleaning blade which is provided in a cleaning device that removes non-transferred toner remaining on an image carrier. The cleaning blade includes a blade member in which an edge thereof is in contact with the image carrier over a longitudinal direction thereof; and a holder member that holds the blade member and has an L-shape in a cross-section that is perpendicular to the longitudinal direction. The holder member includes a supporting portion that cantilevers the blade member on a surface thereof such that the edge of the blade member protrudes toward the image carrier, and a bent portion that is connected to the supporting portion to form the L-shaped cross-section and is formed to have a lateral length that is shorter at least a lateral length at one end portion in the longitudinal direction thereof than at a middle portion thereof in the longitudinal direction.

According to another aspect of the present invention, there is provided a holder member for holding a cleaning blade which is provided in a cleaning device that removes non-transferred toner remaining on an image carrier, and in which an edge thereof is in contact with the image carrier over a longitudinal direction thereof. The holder member has an L-shape in a cross-section that is perpendicular to the longitudinal direction. The holder member includes a supporting portion that cantilevers the blade member on a surface thereof such that the edge of the blade member protrudes toward the image carrier, and a bent portion that is connected to the supporting portion to form the L-shaped cross-section and is formed in such a manner that at least a lateral length at one end portion thereof in the longitudinal direction is shorter than a lateral length at a middle portion in the longitudinal direction.

In this application, the term "process cartridge" is defined as a unit which is configured by integrating an image carrier with at least one of a charging unit that charges an image carrier, a developing device (developing unit) that develops a latent image formed on the image carrier, and a cleaning device (cleaning unit) that cleans the image carrier, and which is removably attached to the main body of an image forming apparatus.

Moreover, in this application, the term "longitudinal direction" is defined as the direction identical to the direction of an axis of rotation (or a main-scanning direction) of the image carrier. Moreover, the term "lateral direction" is defined as a direction perpendicular to the "longitudinal direction."

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
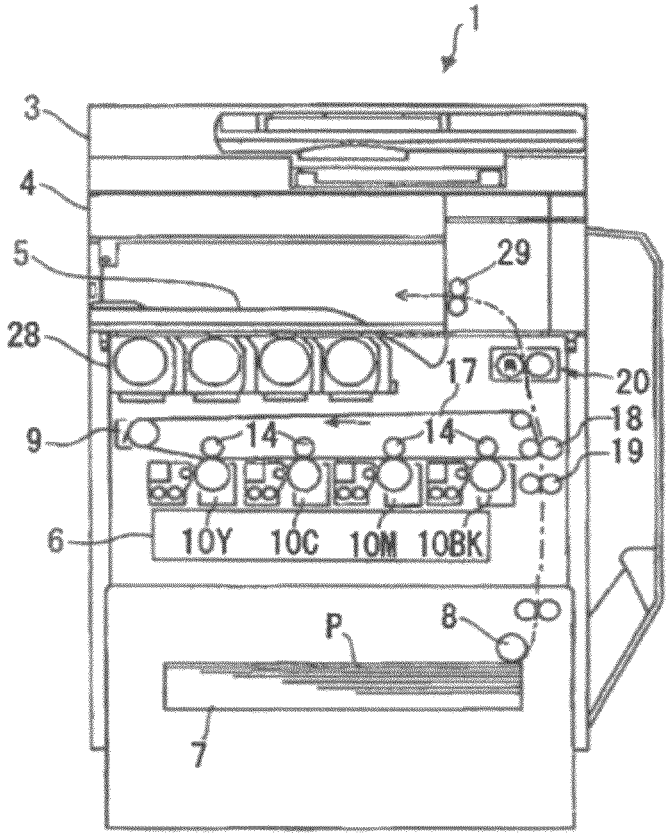
FIG. 1 is a diagram illustrating an overall configuration of an image forming apparatus according to a first embodiment of the present invention.

Hereinafter, embodiments for carrying out the present invention will be described in detail with reference to the drawings. In the respective drawings, the same or corresponding portions will be denoted by the same reference numerals, and redundant description thereof is appropriately simplified or not provided.

First Embodiment

A first embodiment of the present invention will be described in detail with reference to FIGS. 1 to 6.

First, the overall configuration and operation of an image forming apparatus will be described with reference to FIG. 1.

An image forming apparatus 1 of the first embodiment is a tandem-type color image forming apparatus in which process cartridges 10Y, 10M, 10C, and 10BK serving as a plurality of image forming units are arranged in line so as to face an intermediate transfer belt 17.

FIG. 1 illustrates a main body of a color copying machine serving as an image forming apparatus 1, a document reading unit 4 that scans image information of a document, a document conveying unit 3 that feeds documents to the document reading unit 4, a writing unit 6 (exposing unit) that emits a laser beam based on input image information, a paper feeding unit 7 in which recording media P such as transfer paper sheets are stored, process cartridges 10Y, 10M, 10C, and 10BK serving as image forming units corresponding to respective colors (yellow, magenta, cyan, and black), an intermediate transfer belt (intermediate transfer member) 17 to which toner images of a plurality of colors are superimposed and transferred, a secondary transfer roller 18 that transfers the toner images formed on the intermediate transfer belt 17 to the recording medium P, a fixing unit 20 that fixes a not-yet-fixed image on the recording medium P, and a toner container 28 for supplying toner of the respective colors to the developing devices of the respective process cartridges 10Y, 10M, 10C, and 10BK.

Figure 2:
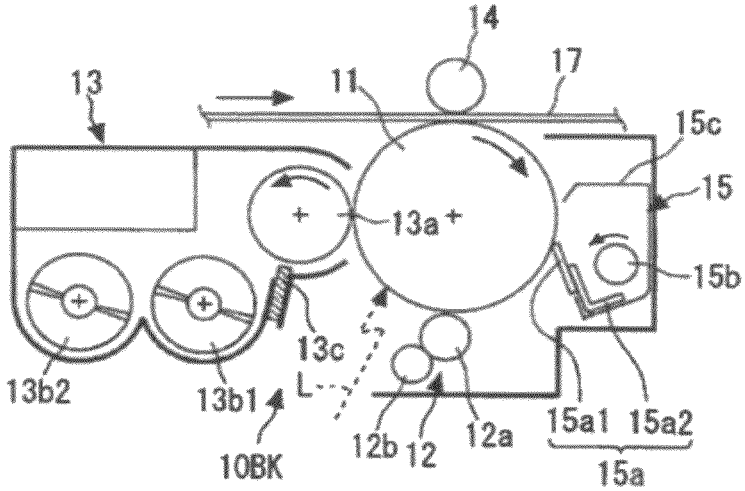
FIG. 2 is a diagram illustrating a configuration of an image forming unit.

Here, each of the process cartridges (image forming units) 10Y, 10M, 10C, and 10BK is one in which a photosensitive element 11 serving as an image carrier, a charging unit 12, a developing device (developing unit) 13, and a cleaning device (cleaning unit) 15 are integrated with one another (see FIG. 2). Each of the process cartridges 10Y, 10M, 10C, and 10BK is replaced with a new cartridge when they a life span ends.

Toner images of the respective colors (yellow, magenta, cyan, and black) are formed on the photosensitive elements (image carriers) 11 of the respective process cartridges 10Y, 10M, 10C, and 10BK.

Hereinafter, the operation of the image forming apparatus during normal color image formation will be described.

First, a document is conveyed from a document table by a conveying roller of the document conveying unit 3 and placed on a contact glass of the document reading unit 4. The document reading unit 4 optically reads the image information of the document placed on the contact glass.

Specifically, the document reading unit 4 scans the document on the contact glass by irradiating the image of the document with light emitted from an illumination lamp. Moreover, light reflected from the document is imaged onto a color sensor through a group of mirrors and lenses. The color image information of the document is color-separated according to the RGB (red, green, and blue) color format. Each color-separated component is, after being read by a color sensor, converted into an electrical image signal. Based on the color-separated image signals in the RGB color format, processing such as color conversion, color correction, and spatial frequency correction is performed in an image processing unit (not shown), whereby color image information of the color components of yellow, magenta, cyan, and black is obtained.

The image information of the respective color components of yellow, magenta, cyan, and black, is transmitted to the writing unit 6. The writing unit 6 irradiates the photosensitive elements 11 of the corresponding process cartridges 10Y, 10M, 10C, and 10BK with laser beams (exposure light) based on the image information of the respective colors.

The four photosensitive elements 11 rotate in the clockwise direction in the figure. Taking the color of black as an example, the surface of the photosensitive elements 11 is uniformly charged at a position to face a charging roller 12*a* (see FIG. 2) of the charging unit 12 (a charging process). In this way, a charge potential is formed on the photosensitive elements 11. After that, the charged surface of the photosensitive element 11 reaches an irradiation position where the laser beam is irradiated to the surface of the photosensitive element 11 (same for other colors).

In the writing unit 6, laser beams corresponding to the image signals are emitted from light sources corresponding to the respective colors. Although not shown in the figure, the laser beams pass through a plurality of lenses after being incident on and reflected from a polygon mirror. The laser beams having passed through the plurality of lenses travel along different optical paths for each of the color components of yellow, magenta, cyan, and black (an exposure process).

A laser beam corresponding to a yellow component is irradiated on the surface of the photosensitive element 11 of the first process cartridge 10Y from left in the plane of the drawing. In this case, the laser beam of the yellow component is scanned in the direction of the axis of rotation (a main-scanning direction) of the photosensitive element by the polygon mirror (not shown) rotating at a high speed. In this way, an electrostatic latent image corresponding to the yellow component is formed on the photosensitive element 11 which has been charged by the charging roller 12*a*.

Similarly, a laser beam of a cyan component is irradiated on the surface of the photosensitive element 11 of the second process cartridge 10C from left in the plane of the drawing, whereby an electrostatic latent image of the cyan component is formed. A laser beam of a magenta component is irradiated on the surface of the photosensitive element 11 of the third process cartridge 10M from left in the plane of the drawing, whereby an electrostatic latent image corresponding to the magenta component is formed. A laser beam of a black component is irradiated on the surface of the photosensitive element 11 of the fourth process cartridge (black image forming unit) 10BK (the most downstream side in the moving direction of the intermediate transfer belt 17) from left in the plane of the drawing, whereby an electrostatic latent image of the black component is formed.

After that, the surfaces of the photosensitive elements 11 on which the electrostatic latent images of the respective colors are formed reach positions to face the respective developing devices 13 (see FIG. 2). Toner of the respective colors is supplied from the respective developing devices 13 to the photosensitive elements 11, thereby the latent images on the photosensitive elements 11 are developed (a developing process).

After that, the surfaces of the photosensitive elements 11 that have passed through the developing process reach positions to face the intermediate transfer belt 17. Here, at each of the facing positions, a primary transfer roller 14 is arranged so as to be in contact with the inner circumferential surface of the intermediate transfer belt 17. Moreover, at the position of the primary transfer roller 14, the toner images of the respective colors formed on the photosensitive elements 11 are sequentially transferred to the intermediate transfer belt 17 by being superimposed of one another (a first transfer process).

Moreover, the surfaces of the photosensitive elements 11 that have passed through the first transfer process reach positions to face the cleaning device 15 (in which a cleaning blade 15*a* is formed, see FIG. 2). In the cleaning device 15, non-transferred toner remaining on the photosensitive elements 11 is collected (a cleaning process).

Thereafter, each of the surfaces of the photosensitive elements 11 passes through the position of a discharging unit (not shown), whereby a series of image formation processes for each of the photosensitive elements 11 ends.

On the other hand, the surface of the intermediate transfer belt 17, to which the toner images of the respective colors on the photosensitive elements 11 are transferred by the superimposition, moves in the direction indicated by the arrow in FIG. 1 to reach the position of the secondary transfer roller 18, where the full-color toner image on the intermediate transfer belt 17 is secondary-transferred to the recording medium P (a secondary transfer process).

Afterward, the surface of the intermediate transfer belt 17 reaches the position of an intermediate transfer belt-cleaning device 9. Then, the non-transferred toner remaining on the intermediate transfer belt 17 is collected by the intermediate transfer belt-cleaning device 9, whereby a series of transfer processes on the intermediate transfer belt 17 ends.

Here, the recording medium P at the position of the secondary transfer roller 18 is one which has been conveyed from the paper feeding unit 7 through a conveying guide, a registration roller 19, and the like.

Specifically, the recording medium P, fed by a feeding roller 8 from the paper feeding unit 7 in which the recording medium P has been stored, is guided to the registration roller 19 after passing through the conveying guide. The recording medium P having reached the registration roller 19 is conveyed toward the position of the secondary transfer roller 18 in synchronization with the conveyance of the toner image on the intermediate transfer belt 17.

Thereafter, the recording medium P to which a full-color image has been transferred is guided to the fixing unit 20. In the fixing unit 20, a color image is fixed to the recording medium P at the nip between a fixing roller and a pressing roller.

The recording medium P that has gone through the fixing process is ejected as an output image to the outside of the main body of the image forming apparatus 1 by a discharge roller 29 and stacked on a discharge unit 5, whereby a series of image formation processes end.

Next, the image forming unit of the image forming apparatus will be described in detail with reference to FIG. 2.

FIG. 2 shows the configuration of the black process cartridge 10BK. The other three process cartridges 10Y, 10M, and 10C have substantially the same configuration as the black process cartridge 10BK except that the colors of the toner used in the image formation processes is different from each other. Thus, the illustration and description thereof will be omitted.

As illustrated in FIG. 2, in the process cartridge 10BK, the photosensitive element 11 serving as the image carrier, the charging unit 12 that charges the photosensitive element 11, the developing device 13 that develops the electrostatic latent image formed on the photosensitive element 11, and the cleaning device 15 that collects the non-transferred toner on the photosensitive element 11 are integrally housed in a casing.

Here, the photosensitive element 11 serving as the image carrier is a negatively charged organic photosensitive element in which a photosensitive layer or the like is formed on a drum-shaped conductive supporting member.

Although not shown in the figure, the photosensitive element 11 has a configuration in which an undercoating layer which is an insulating layer, a charge generation layer serving as photosensitive layers and a charge transport layer, and a protective layer (surface layer) are sequentially laminated on a conductive supporting member serving as a base layer.

As the conductive supporting member (base layer) of the photosensitive element 11, a conductive material having a volume resistance of $10^{10}$ ohm-cm or less can be used.

The charging unit 12 includes a charging roller 12*a*, a cleaning roller 12*b*, and the like. The charging roller 12*a* is a roller member in which an elastic layer having a medium resistance is coated around the circumference of a conductive bar. The cleaning roller 12*b* is provided to remove stain on the charging roller 12*a* and is arranged to be in contact with the charging roller 12*a*.

In the charging unit 12 thus configured, a predetermined amount of voltage is applied to the charging roller 12*a* from a power supply (not shown), whereby the surface of the photosensitive element 11 facing the charging roller 12*a* is uniformly charged.

The developing device (developing unit) 13 mainly includes a developing roller 13*a* facing the photosensitive element 11, a first conveying screw 13*b*1 facing the developing roller 13*a*, a second conveying screw 13*b*2 facing the first conveying screw 13*b*1 with a partition member disposed therebetween, and a doctor blade 13*c* facing the developing roller 13*a*. The developing roller 13*a* includes a magnet that is fixed to the inner side therein so as to form a magnetic field on the peripheral surface of the developing roller 13*a* and a sleeve that rotates around the magnet. A magnetic field with a varying direction of magnetic flux is formed on the developing roller (the sleeve) 13*a* by the magnet, whereby a developer is carried on the developing roller 13*a*. A two-component developer made up of a carrier and a toner is stored in the developing device 13.

In the cleaning device 15, a cleaning blade 15*a* that is in contact with the photosensitive element 11, a conveying coil 15*b* (hereinafter, also referred to as a "conveying screw") serving as a conveying member that conveys toner (non-transferred toner) collected in the cleaning device 15 as a waste toner in the longitudinal direction toward a waste toner collecting container (not shown) disposed outside the cleaning device 15, a casing 15*c* that covers the cleaning device 15, and the like are provided.

The cleaning blade 15*a* mainly includes a blade member (blade body) 15*a*1 formed in an approximately planar shape using a rubber material such as urethane rubber and a holder member (blade holder) 15*a*2 that is formed of a metal plate to hold the blade member 15*a*1. The blade member 15*a*1 of the cleaning blade 15*a* is in contact with the surface of the photosensitive element 11 at a predetermined angle and with a predetermined pressure. With this configuration, adhering materials such as non-transferred toner adhering on the photosensitive element 11 is mechanically scraped by the cleaning blade 15*a* and collected into the cleaning device 15.

Here, examples of the adhering materials adhering onto the photosensitive element 11 include paper powder generated from the recording medium (sheet) P, corona products generated on the photosensitive element 11 during the discharge by the charging roller 12*a*, and additives added to the toner, in addition to the non-transferred toner.

The cleaning device 15 will be described later in more detail.

The image formation process described above will be described in more detail with reference to FIG. 2.

The developing roller 13*a* rotates in a direction (counter-clockwise direction) indicated by the arrow in FIG. 2. A developer in the developing device 13 circulates in the longitudinal direction (a direction perpendicular to the plane of FIG. 2) while being stirred and mixed with the toner, supplied from a toner container 28 by a toner supply unit (not shown), by the rotation of the first conveying screw 13*b*1 and the second conveying screw 13*b*2 which are arranged with the partition member interposed therebetween.

Moreover, the toner adsorbed onto the carrier through frictional charging is carried on the developing roller 13*a* together with the carrier. After that, the developer carried on the developing roller 13*a* reaches the position of the doctor blade 13*c*, where the amount of the developer on the developing roller 13*a* is adjusted to an appropriate amount, and then, the developer reaches the position (a developing region) to face the photosensitive element 11.

After that, in the developing region, the toner in the developer adheres to the electrostatic latent image formed on the surface of the photosensitive element 11. Specifically, the toner adheres to the latent image (namely, a toner image is formed) by an electric field formed by a potential difference (developing potential) between the potential (exposure potential) of the latent image in an image formation region irradiated with laser beams L and the developing bias applied to the developing roller 13*a*.

After that, in the developing process, most of the toner adhering to the photosensitive element 11 is transferred to the intermediate transfer belt 17. Moreover, the non-transferred toner remaining on the photosensitive element 11 is cleaned by the cleaning blade 15*a* (namely, the non-transferred toner is collected into the cleaning device 15).

Here, although not shown in the figure, the toner supply unit includes the bottle-shaped toner container 28 configured to be replaceable and a toner hopper unit that holds and rotates the toner container 28 and supplies new toner to the developing device 13. New toner (any one of the colors of yellow, magenta, cyan, and black) is stored in the toner container 28. A spiral protrusion is formed on the inner circumferential surface of the toner container (toner bottle) 28.

The new toner in the toner container 28 is supplied to the developing device 13 through a toner supply opening appropriately in accordance with the consumption of the toner (stored toner) in the developing device 13. Although not shown in the figure, the consumption of the toner in the developing device 13 is indirectly or directly detected by a reflection-type photo-sensor that faces the photosensitive element 11 and a magnetic sensor that is provided below the second conveying screw 13*b*2 of the developing device 13.

Hereinafter, a characteristic configuration of the cleaning device 15 according to the first embodiment will be described.

As described above in FIG. 2, in the first embodiment, the cleaning blade 15*a* provided in the cleaning device 15 mainly includes the blade member (the blade body) 15*a*1 formed of a rubber material and the holder member (the blade holder) 15*a*2 that holds the blade member 15*a*1.

Here, an edge of the blade member 15*a*1 is in contact with the photosensitive element 11 over the longitudinal direction (the direction perpendicular to the plane of FIG. 2), and a base thereof is fixed and held by the holder member 15*a*2.

Moreover, the holder member 15*a*2 is formed in an approximately L-shape in a cross-sectional view that is perpendicular to the longitudinal direction. In addition, referring to FIG. 3, the holder member 15*a*2 includes a supporting portion 15*a*21 and a bent portion 15*a*22.

Figure 3:
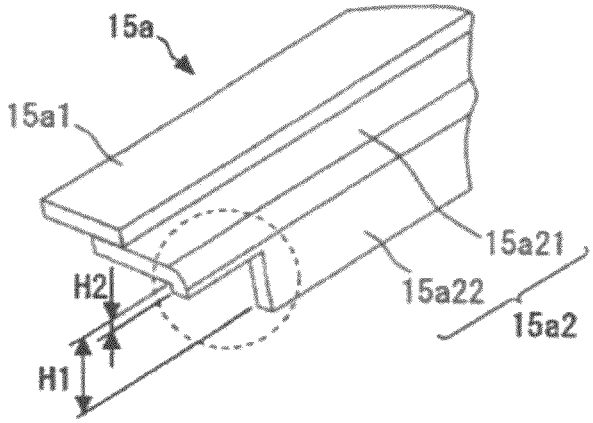
FIG. 3 is a perspective view illustrating a cleaning blade.

Referring to FIG. 3, the supporting portion (fixing portion) 15*a*21 of the holder member 15*a*2 is configured to support the blade member 15*a*1 such that the holder member 15*a*2 cantilevers the blade member 15*a*1 on a surface thereof and the edge of the blade member 15*a*1 protrudes toward the photosensitive element 11. Specifically, the blade member 15*a*1 is bonded to the surface of the supporting portion 15*a*21 by a double-sided adhesive tape or an adhesive agent.

The bent portion 15*a*22 of the holder member 15*a*2 is connected to the supporting portion 15*a*21 to thereby form the L-shaped cross-sectional shape together with the supporting portion 15*a*21. Moreover, the bent portion 15*a*22 is formed in such a manner that at least the lateral length H2 at an end portion thereof in the longitudinal direction is shorter than the lateral length H1 at a middle portion thereof in the longitudinal direction (namely, H1>H2). In other words, the bent portion 15*a*22 of the holder member 15*a*2 has a cutout (a portion surrounded by the broken line in FIG. 3) at the end portion thereof in the longitudinal direction.

With this configuration, the rigidity of the holder member 15*a*2 is lower at the end portion in the longitudinal direction than at the middle portion in the longitudinal direction. Thus, the contact pressure of the blade member 15*a*1, which is in contact with the photosensitive element 11, at the end portion in the longitudinal direction where an insufficient amount of non-transferred toner is supplied to the blade member 15*a*1 is lower than that at the middle portion in the longitudinal direction where a sufficient amount of non-transferred toner is supplied to the blade member 15*a*1. That is, the holder member 15*a*2 is configured such that the force (rigidity) to hold the blade member 15*a*1 is relatively weak at the end portion in the longitudinal direction where an insufficient amount of non-transferred toner is supplied to the blade member 15*a*1 and where hence the blade member 15*a*1 is likely to be rolled up or cause vibration to make noises. That is, the holder member 15*a*2 is configured in such a manner that the contact pressure of the blade member 15*a*1 is relatively weak at the end portion. Because the rolling up or the vibration, which results in noises, of the blade member 15*a*1 is associated with the magnitude of the contact pressure of the blade member 15*a*1, it is possible to reliably suppress the occurrence of the rolling up or the vibration, which results in noises, of the blade member 15*a*1 at the end portion in the longitudinal direction. In addition, because the amount of non-transferred toner supplied to the end portion of the blade member 15*a*1 in the longitudinal direction thereof is originally small, insufficient cleaning due to a decrease in the contact pressure of the blade member 15*a*1 will occur rarely.

In the first embodiment, in order to decrease the rigidity of the holder member 15*a*2 at the end portion thereof in the longitudinal direction as compared to that at the middle portion thereof in the longitudinal direction, a cutout is formed in the bent portion 15*a*22 and not in the supporting portion 15*a*21. That is, the surface of the supporting portion 15*a*21 is formed in a rectangular shape over the longitudinal direction thereof with no cutout formed thereon. Thus, a large attachment surface (attachment zone) for bonding the blade member 15*a*1 uniformly over the longitudinal direction can be secured on the surface of the supporting portion 15*a*21. Therefore, it is possible to prevent the occurrence of a problem in which the attachment strength of the blade member 15*a*1 to the surface of the supporting portion 15*a*21 is not sufficient so that the blade member 15*a*1 is set apart from the supporting portion 15*a*21.

In the first embodiment, a cutout resulting in the lateral length H2 being short is formed only at one of two end portions in the longitudinal direction of the bent portion 15*a*22 included in the holder member 15*a*2.

Figure 4:
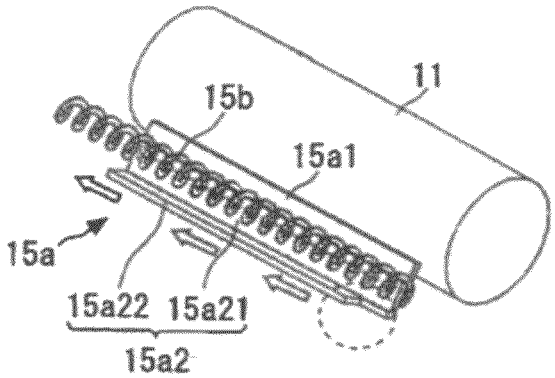
FIG. 4 is a perspective view illustrating the cleaning blade and a conveying coil.

Specifically, as illustrated in FIG. 4, the bent portion 15*a*22 of the holder member 15*a*2 is formed in such a manner that the lateral length at an end portion thereof in the longitudinal direction corresponding to the upstream side in the conveying direction of the conveying coil 15*b* is shorter than the lateral length at the other portions thereof in the longitudinal direction. That is, in the bent portion 15*a*22 of the holder member 15*a*2, a cutout (a portion surrounded by the broken line in FIG. 4) is formed at an end thereof in the longitudinal direction corresponding to the upstream side in the conveying direction (a direction indicated by the outlined arrows in FIG. 4) of the toner (non-transferred toner) conveyed by the conveying coil 15*b*, but no cutout is formed at an end thereof in the longitudinal direction corresponding to the downstream side in the conveying direction.

At the position (the end portion in the longitudinal direction) corresponding to the upstream side in the conveying direction of the conveying coil 15*b*, because the toner (which is originally a small amount of toner) scraped from the photosensitive element 11 by the blade member 15*a*1 is conveyed toward the downstream side immediately by the conveying screw 15*b*, a very small amount of toner will be present at the edge of the blade member 15*a*1. In contrast, at the position (the end portion in the longitudinal direction) corresponding to the downstream side in the conveying direction of the conveying coil 15*b*, although an amount of toner that is directly scraped from the photosensitive element 11 by the blade member 15*a*1 is small, there remains a relatively large amount of toner that is conveyed from the upstream side by the conveying screw 15*b*. Thus, a considerable amount of toner is likely to be present at the edge of the blade member 15*a*1. Therefore, the rolling up of the blade member 15*a*1 or the noise attributable to the vibration of the blade member 15*a*1 is not likely to occur or be generated even when no cutout is formed in the bent portion 15*a*22 at the position (the end portion in the longitudinal direction) corresponding to the downstream side in the conveying direction of the conveying coil 15*b*.

In a cleaning device in which no conveying member like the conveying coil 15*b* is provided, or a cleaning device in which a conveying member like the conveying coil 15*b* is disposed below the blade member 15*a*1 at a large distance, it may be difficult to obtain the effect of allowing the toner conveyed by the conveying coil 15*b* to be present at the edge of the blade member 15*a*1. In this case, it is preferable to form a cutout at each of the ends in the longitudinal direction of the bent portion 15*a*22 of the holder member 15*a*2.

Figure 5:
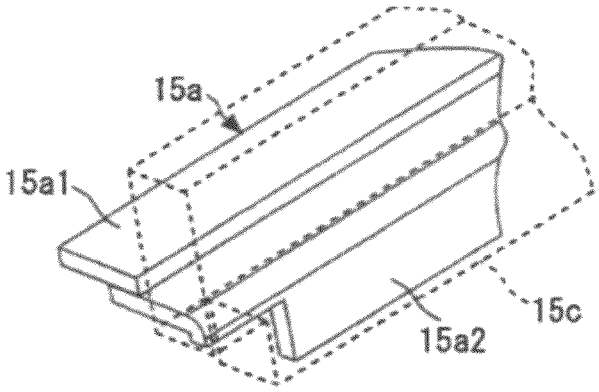
FIG. 5 is a perspective view illustrating part of the casing of a cleaning device.

In the first embodiment, as illustrated in FIG. 5, the casing (device cover) 15*c* that covers the entire device together with the cleaning blade 15*a* is formed so as to comply with the shape of the holder member 15*a*2. Specifically, a recess is formed in the casing 15*c* so as to comply with the shape of the cutout formed in the bent portion 15*a*22 of the holder member 15*a*2. With such a configuration, it is possible to decrease the overall size of the cleaning device 15 to the size as small as possible, to decrease the interference with the process cartridge 10BK or the main body of the image forming apparatus 1, and effectively use the recess, provided for space-saving, in the process cartridge 10BK or the main body of the image forming apparatus 1.

In the first embodiment, as illustrated in FIG. 3, the lateral length H2 of the bent portion 15*a*22 of the holder member 15*a*2 at the end portion thereof in the longitudinal direction is set to be around several millimeters.

Figure 6:
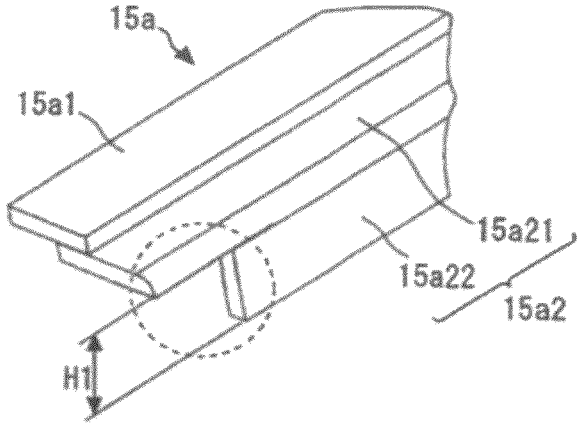
FIG. 6 is a perspective view illustrating another example of the cleaning blade.

In contrast, as illustrated in FIG. 6, the lateral length of the bent portion 15*a*22 of the holder member 15*a*2 at the end portion thereof in the longitudinal direction may be set to 0 mm. That is, substantially no bent portion 15*a*22 may be formed at the end of the holder member 15*a*2 in the longitudinal direction thereof.

In this case, too, it is possible to obtain the effects of the first embodiment.

As described above, according to the first embodiment, the bent portion 15*a*22 of the holder member 15*a*2 is formed such that the lateral length H2 at the end portion in the longitudinal direction thereof is shorter than the lateral length H1 at the middle portion in the longitudinal direction thereof. With this configuration, it is possible to reliably suppress the occurrence of the rolling up of the blade member 15*a*1 or noises attributable to the vibration of the blade member 15*a*1 (the cleaning blade 15*a*) without causing a side effect such as insufficient cleaning.

Second Embodiment

A second embodiment of the present invention will be described in detail with reference to FIGS. 7 to 10E.

Figure 7:
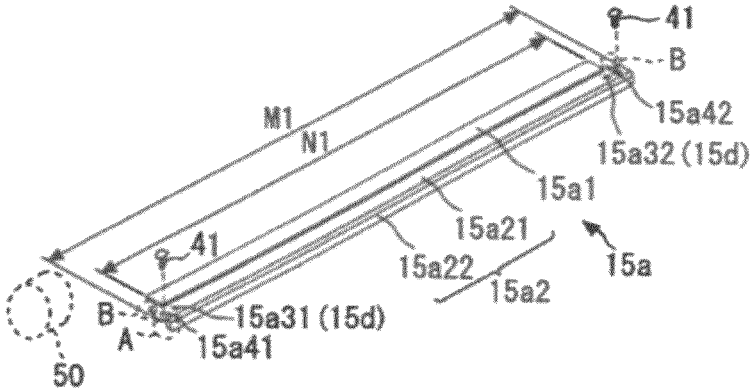
FIG. 7 is a perspective view illustrating a cleaning blade according to a second embodiment of the present invention.
Figure 8:
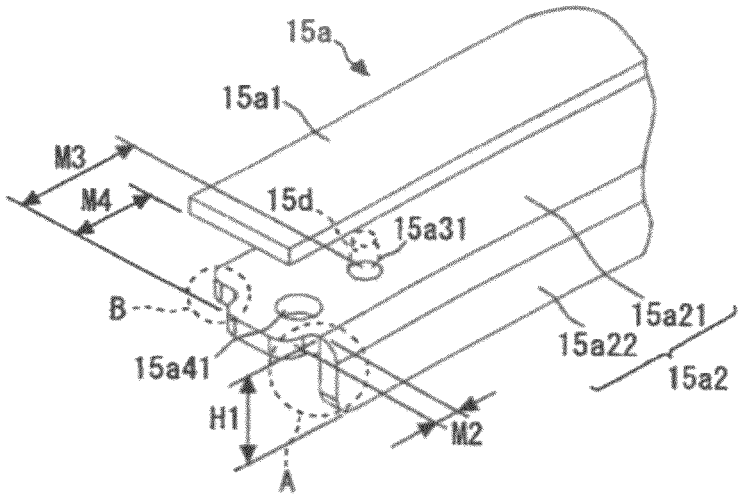
FIG. 8 is a partially enlarged perspective view illustrating one of ends, in the longitudinal direction, of the cleaning blade illustrated in FIG. 7.

FIG. 7 is a perspective view illustrating a cleaning blade according to the second embodiment of the present invention, and FIG. 8 is a partially enlarged perspective view illustrating an end portion of the cleaning blade in the longitudinal direction thereof. FIGS. 9A to 9D are diagrams illustrating a method of manufacturing a cleaning blade, and FIGS. 10A to 10E are diagrams illustrating another method of manufacturing the cleaning blade. In FIGS. 9A to 10E, the illustrations of the details of the cleaning blade 15*a* are simplified.

The cleaning blade 15*a* of the second embodiment is mainly different from that of the first embodiment in that the blade member 15*a*1 of the first embodiment is provided over the entire longitudinal direction of the supporting portion 15*a*21 whereas the blade member 15*a*1 of the second embodiment is not provided over the entire longitudinal direction of the supporting portion 15*a*21.

A cleaning device of the second embodiment includes, similarly to the first embodiment, the cleaning blade 15*a* that is in contact with the photosensitive element 11. Moreover, as illustrated in FIGS. 7 and 8, the cleaning blade 15*a* mainly includes a blade member (blade body) 15*a*1 formed in an approximately planar shape using a rubber material such as urethane rubber and a holder member (blade holder) 15*a*2 that is formed of a metal plate and holds the blade member 15*a*1. In addition, in the cleaning blade 15*a* of the second embodiment, a cutout (a portion surrounded by the broken line "A" in FIG. 8) is also formed at an end in the longitudinal direction of the bent portion 15*a*22 of the holder member 15*a*2.

In the cleaning blade 15*a* of the second embodiment, a main reference portion (hole) 15*a*31 and a sub reference portion (slot hole) 15*a*32 for positioning the cleaning blade 15*a* with respect to the cleaning device 15 are formed on the holder member 15*a*2 at both ends in the longitudinal direction so as to be separated from each other in the longitudinal direction.

Specifically, in the supporting portion 15*a*21 of the holder member 15*a*2, the main reference portion (hole) 15*a*31 serving as the main reference for performing positioning with respect to the casing (not shown) of the cleaning device 15 is formed at an end in the longitudinal direction, and at the sub reference portion (slot hole) 15*a*32 serving as the sub reference for positioning with respect to the casing of the cleaning device 15 is formed at the other end in the longitudinal direction. Moreover, two bosses 15*d* standing on the casing (not shown) of the cleaning device 15 are engaged with the main reference portion (hole) 15*a*31 and the sub reference portion (slot hole) 15*a*32, whereby the position of the cleaning blade 15*a* (the holder member 15*a*2) relative to the cleaning device 15 is determined.

In the second embodiment, the main reference portion 15*a*31 is a hole having a diameter of 3 mm, and the sub reference portion 15*a*32 is a slot hole having dimensions of 4 mm in width and 7 mm in length.

Furthermore, a screw locking hole 15*a*41 and a screw locking slot hole 15*a*42 for fixing the cleaning blade 15*a* to the cleaning device 15 are formed in the holder member 15*a*2 at both ends in the longitudinal direction so as to be separated in the longitudinal direction from each other.

Specifically, in the supporting portion 15*a*21 of the holder member 15*a*2, the screw locking hole 15*a*41 for fastening a screw to the casing of the cleaning device 15 is formed at an end in the longitudinal direction, and the screw locking slot hole 15*a*42 for fastening a screw to the casing of the cleaning device 15 is formed at the other end in the longitudinal direction. In a state where positioning is realized by engaging the bosses 15*d* with the main reference portion (hole) 15*a*31 and the sub reference portion (slot hole) 15*a*32, each of screws 41 (which is a M4 screw) is screw-locked on each of two internal screw threads that are formed on the casing through the screw locking hole 15*a*41 and the screw locking slot hole 15*a*42. In this way, the cleaning blade 15*a* (the holder member 15*a*2) is fixed (screw-locked) to the cleaning device 15.

In the second embodiment, the screw locking hole 15*a*41 is a hole having a diameter of 4 mm, and the screw locking slot hole 15*a*42 is a slot hole having dimensions of 5 mm in width and 9 mm in length. Moreover, an M4 screw is used as the screw 41.

In the second embodiment, the bent portion 15*a*22 of the holder member 15*a*2 is formed in such a manner that the lateral length at an end thereof in the longitudinal direction thereof where the main reference portion 15*a*31 is formed is shorter than the lateral length H1 at the other portions thereof in the longitudinal direction (the former lateral length is set to 0 mm similarly to that described in FIG. 6). That is, in the bent portion 15*a*22 of the holder member 15*a*2, a cutout (a portion surrounded by the broken line "A" in FIGS. 7 and 8) is formed at an end thereof in the longitudinal direction where the main reference portion (hole) 15*a*31 is formed, but no cutout is formed at the other end thereof in the longitudinal direction where the sub reference portion (slot hole) 15*a*32 is formed.

At the position (the end in the longitudinal direction) where the main reference portion 15*a*31 is formed, because the holder member 15*a*2 is tightly fixed (positioned) to the casing of the cleaning device 15, the vibration may not be released when the same impact is applied as compared to the position where the sub reference portion 15*a*32 is formed. Thus, vibration is transmitted from the holder member 15*a*2 to the blade member 15*a*1, whereby the blade member 15*a*1 is likely to be rolled up or cause vibration to make noises at the side where the main reference portion 15*a*31 is formed. Therefore, in the second embodiment, a cutout A is formed in the bent portion 15*a*22 at one end in the longitudinal direction (the side where the main reference portion 15*a*31 is formed) where the blade member 15*a*1 is likely to be rolled up or cause vibration to make noises to thereby decrease rigidity at that position, so that vibration can easily be released when impact is applied.

Furthermore, in the second embodiment, the bent portion 15*a*22 of the holder member 15*a*2 is formed in a manner such that the lateral length thereof at an end in the longitudinal thereof corresponding to a side where a driving unit (driving motor) 50 for driving the photosensitive element 11 is disposed is shorter than the lateral length H1 thereof at the other portions in the longitudinal direction. That is, in the bent portion 15*a*22 of the holder member 15*a*2, a cutout (a portion surrounded by the broken line "A" in FIGS. 7 and 8) is formed at the end in the longitudinal direction where the driving motor (driving unit) 50 is disposed, and no cutout is formed at the other end in the longitudinal direction where the driving motor 50 is not disposed.

At the side (driving side) where the driving motor 50 is disposed, vibration of the driving motor 50 is likely to be transmitted to the blade member 15*a*1 of the cleaning device 15 as compared to the side (driven side) where the driving motor 50 is not disposed. Thus, the blade member 15*a*1 is likely to be rolled up or cause vibration to make noises at the driving side. Therefore, in the second embodiment, the cutout A is formed in the bent portion 15*a*22 at one end in the longitudinal direction (the side where the driving motor 50 is disposed) where the blade member 15*a*1 is likely to be rolled up or cause vibration to make noises to thereby decrease rigidity at that position, so that vibration can be easily released when impact is applied.

The driving motor 50 transmits a driving force to a driving member (the conveying coil 15*b* and the like) of the cleaning device 15 through a gear train (not shown).

In the second embodiment, the cleaning device 15 and the main body of the image forming apparatus 1 are designed so that the following end portions coincide with one another: one end in the longitudinal direction where the main reference portion 15*a*31 is disposed, one end in the longitudinal direction corresponding to a side where a driving unit 50 is disposed, and one end in the longitudinal direction corresponding to the upstream side in the conveying direction of the conveying coil 15*b* described in the first embodiment. Thus, it is possible to securely obtain the effect of suppressing the occurrence of the rolling up of the blade member 15*a*1 or the noises attributable to vibration of the blade member 15*a*1.

Referring to FIG. 7, in the cleaning blade 15*a* of the second embodiment, the length N1 of the blade member 15*a*1 in the longitudinal direction thereof is set to 321.5 mm, and the length (entire length) M1 of the holder member 15*a*2 in the longitudinal direction thereof is set to 345 mm. Moreover, referring to FIG. 8, the length M2 of the cutout A in the longitudinal direction thereof is set to 3 mm, the distance M4 from the end of the holder member 15*a*2 to the end of the blade member 15*a*1 is set to 9 mm, the distance M3 from the end of the holder member 15*a*2 to the center of the main reference portion (hole) 15*a*31 is set to 13 mm, and the distance M5 from the end of the holder member 15*a*2 to the center of the screw locking hole 15*a*41 is set to 9 mm.

In the second embodiment, the length M2 of the cutout A in the longitudinal direction thereof is formed to be smaller than the distance M4 from the end of the holder member 15*a*2 to the end of the blade member 15*a*1 (namely, M2<M4). Thus, it is possible to prevent a problem in which the rigidity of the supporting portion (bonding surface) 15*a*21 supporting the blade member 15*a*1 becomes too low.

Moreover, the length M2 of the cutout A in the longitudinal direction thereof is smaller than the distance M3 from the end of the holder member 15*a*2 to the center of the main reference portion (hole) 15*a*31 (namely, M2<M3). Thus, it is possible to suppress a problem in which the rigidity of the holder member 15*a*2 becomes too low so that the accuracy in the positioning of the cleaning blade 15*a* decreases.

Furthermore, in the second embodiment, the length M2 of the cutout A in the longitudinal direction thereof is set to be 1% or less of the length (entire length) M1 of the holder member 15*a*2 in the longitudinal direction thereof (in the second embodiment, the ratio of the lengths is set to be about 0.86%). With this configuration, the effect of suppressing the occurrence of the rolling up of the blade member 15*a*1 or the noises attributable to the vibration of the blade member 15*a*1 is adequately achieved.

In the second embodiment, in order to suppress the occurrence of beeping sound (abnormal sound), the blade member 15*a*1 of the cleaning blade 15*a* is formed of a material that can result in impact resilience at 23° C. of 50% or less. In the second embodiment, the blade member 15*a*1 is formed of a material that results in impact resilience at 23° C. of 21%.

In the blade member 15*a*1 (the cleaning blade 15*a*), the contact pressure (which is linear pressure at the contact portion) at the photosensitive element 11 is set to be in the range of 0.10 to 0.50 N/cm. This is because the beeping sound (abnormal sound) is likely to occur if the contact pressure is greater than 0.50 N/cm, and if the contact pressure is less than 0.10 N/cm, the property of following the micro-unevenness on the surface of the photosensitive element 11 decreases, so that insufficient cleaning is likely to occur. In the second embodiment, the contact pressure of the blade member 15*a*1 is set to 0.23 N/cm.

Furthermore, the blade member 15*a*1 is formed of a material that results in the hardness (Japanese Industrial Standards (JIS)-A hardness at 25° C.) being in the range of 60 to 80. This is because the blade member 15*a*1 is likely to make single-point contact with the photosensitive element 11 if the hardness is greater than 80, and if the hardness is less than 60, the blade member 15*a*1 is likely to make multi-point contact with the photosensitive element 11. In the second embodiment, the blade member 15*a*1 is formed of a material that results in the hardness of 75.

In the cleaning blade 15*a* of the second embodiment, as illustrated in FIGS. 7 and 8, a second cutout (a portion surrounded by the broken line "B" in the figures) for preventing interference with members (a frame or the like of the device) in proximity to the cleaning blade 15*a* is formed at both ends in the longitudinal direction of the supporting portion 15*a*21 of the holder member 15*a*2 in addition to the cutout A for suppressing the occurrence of the rolling up of the blade member 15*a*1 or the noises attributable to vibration of the blade member 15*a*1. The second cutout B is formed in a range such that the second cutout B does not affect the rigidity of the cleaning blade 15*a* (the holder member 15*a*2), the cleaning performance of the cleaning blade 15*a* (the blade member 15*a*1), or the like. Specifically, in the second embodiment, the second cutout B is formed in such a manner that the length in the longitudinal direction of the cleaning blade 15*a* is 3 mm and the length in the lateral direction of the cleaning blade 15*a* is 4.5 mm.

Finally, various methods of manufacturing the cleaning blade 15*a* will be described briefly with reference to FIGS. 9A to 10E.

Figure 9A:
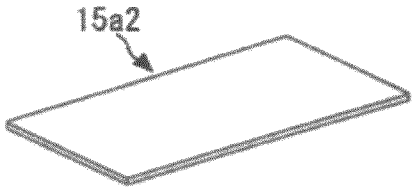
FIGS. 9A to 9D are diagrams illustrating a method of manufacturing a cleaning blade.
Figure 9B:
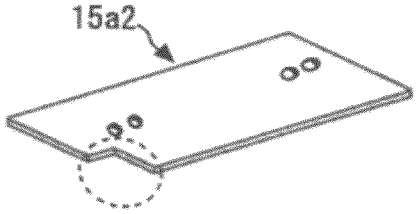

First, a planar metal plate (15*a*2) illustrated in FIG. 9A is prepared, and punching processing illustrated in FIG. 9B is performed on the metal plate (15*a*2). In this case, the cutout A, the main reference portion 15*a*31, the sub reference portion 15*a*32, and the like are formed on the metal plate (15*a*2).

Figure 9C:
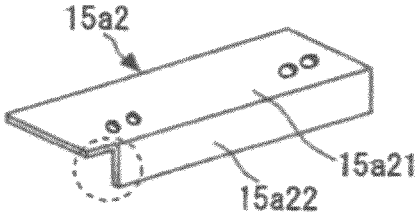
Figure 9D:
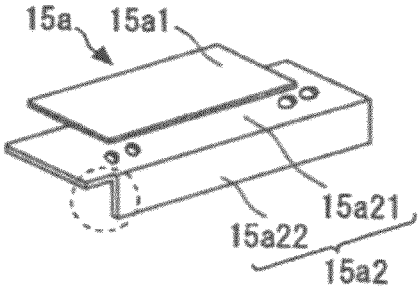

Afterward, as illustrated in FIG. 9C, bending processing is performed, whereby an L-shaped holder member 15*a*2 is formed. Then, as illustrated in FIG. 9D, the blade member 15*a*1 is bonded to the supporting portion 15*a*21 of the holder member 15*a*2, and finally, the manufacturing of the cleaning blade 15*a* ends.

In the manufacturing processes described above, the punching process described in FIG. 9B and the bending process described in FIG. 9C may be performed at the same time.

Figure 10A:
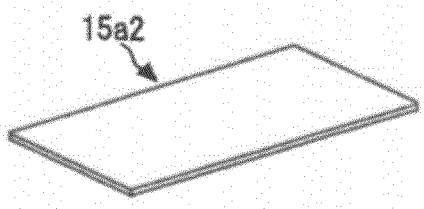
FIGS. 10A to 10E are diagrams illustrating another method of manufacturing the cleaning blade.
Figure 10B:
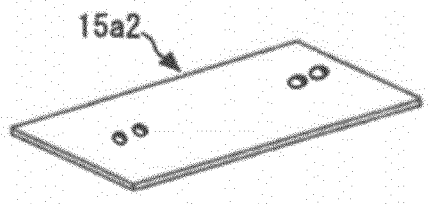

As another manufacturing method, first, a planar metal plate (15*a*2) illustrated in FIG. 10A is prepared, and punching processing illustrated in FIG. 10B is performed on the metal plate (15*a*2). In this case, unlike the manufacturing method described in FIGS. 9A to 9D, no cutout A is formed in the metal plate (15*a*2) by punching processing.

Figure 10C:
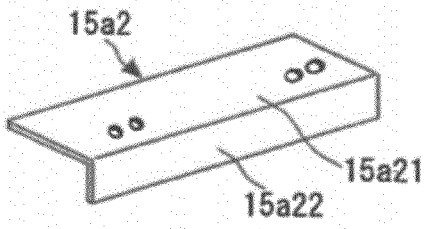
Figure 10D:
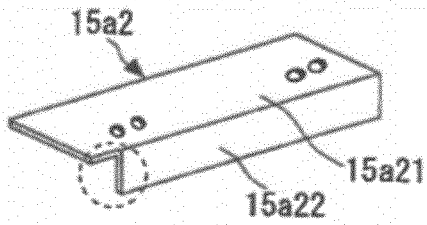
Figure 10E:
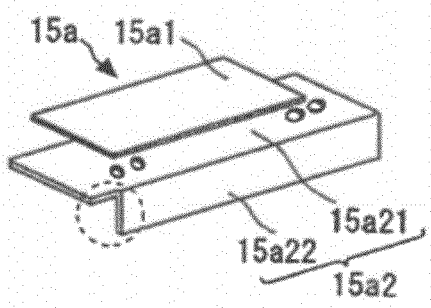

Afterward, as illustrated in FIG. 10C, bending processing is performed, whereby an L-shaped metal plate (15*a*2) is formed. Then, as illustrated in FIG. 10D, cutting processing or fusing processing is performed on the L-shaped metal plate (15*a*2) to form the cutout A, and the manufacturing of the holder member 15*a*2 ends. Moreover, as illustrated in FIG. 10E, the blade member 15*a*1 is bonded to the supporting portion 15*a*21 of the holder member 15*a*2, and finally, the manufacturing of the cleaning blade 15*a* ends.

In the manufacturing processes described above, the punching process described in FIG. 10B and the bending process described in FIG. 10C may be performed at the same time.

Furthermore, the process of forming the cutout A described in FIG. 10D may be performed after the process of bonding the blade member 15*a*1 to the supporting portion 15*a*21 of the holder member 15*a*2 described with reference to FIG. 10E. This means that the cutout A may be formed on the cleaning blade 15*a* (without the cutout A) which is already formed in the cleaning device 15 as post-countermeasures in order to suppress the occurrence of the rolling up of the blade member 15*a*1 or the noises attributable to the blade member 15*a*1.

As described above, according to the second embodiment, similarly to the first embodiment, the bent portion 15*a*22 of the holder member 15*a*2 is formed in such a manner that the lateral length at one end portion in the longitudinal direction is shorter than the lateral length H1 at the middle portion in the longitudinal direction. With this configuration, it is possible to securely suppress the occurrence of the rolling up of the blade member 15*a*1 or the noises attributable to the vibration of the blade member 15*a*1 (the cleaning blade 15*a*) without causing a side effect such as insufficient cleaning.

In the respective embodiments described above, the respective units (the photosensitive element 11, the charging unit 12, the developing unit 13, and the cleaning device 15) of the image forming unit are integrated with one another to form the process cartridges 10Y, 10M, 10C, and 10BK, whereby a reduction in size of the image forming unit and an improvement in workability of the maintenance are realized.

In contrast, the cleaning device 15 may be configured as a single unit so as to be replaceably provided in the device main body 1 rather than configuring the cleaning device 15 as a constituent member of the process cartridge. In such a case, it is also possible to obtain the same effects as those obtained in the respective embodiments.

In the respective embodiments above, although the present invention has been applied to an image forming apparatus in which the two-component type developing unit 13 using a two-component developer is mounted, the present invention can be applied to an image forming apparatus in which a single-component type developing unit 13 using a single-component developer is mounted.

Moreover, in the respective embodiments above, the present invention has been applied to the cleaning device 15 that removes the non-transferred toner remaining on the photosensitive element 11. In contrast, the present invention can be applied to a cleaning device that removes non-transferred toner remaining on the photosensitive belt. Moreover, the present invention can be applied to a cleaning device that removes non-transferred toner remaining on an intermediate transfer member such as an intermediate transfer belt or an intermediate transfer drum. For example, by configuring the intermediate transfer belt-cleaning device 9 illustrated in FIG. 1 so as to have the same configuration as the cleaning device 15 illustrated in FIG. 2, the same effects as those obtained in the respective embodiments can be obtained.

In the respective embodiments above, the present invention has been applied to the cleaning device 15 in which the blade member 15*a*1 formed of a rubber material is provided. In contrast, the present invention can be applied to the cleaning device 15 in which the blade member 15*a*1 formed of a material (for example, a plate spring material) other than the rubber material is provided. In such a case, it is also possible to obtain the same effects as those obtained in the respective embodiments.

According to the aspects of the present invention, the bent portion of the holder member is formed so that the lateral length of one longitudinal end is shorter than the lateral length of the longitudinal middle portion. With this configuration, it is possible to provide a cleaning blade, a cleaning device, a process cartridge, an image forming apparatus, and a holder member, in which a blade member is suppressed from being rolled up or causing vibration to make noises without causing a side effect such as insufficient cleaning.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning blade which is provided in a cleaning device that removes non-transferred toner remaining on an image carrier, comprising:

a blade member in which an edge thereof is in contact with the image carrier over a longitudinal direction thereof; and a holder member that holds the blade member and has an L-shape in a cross-section that is perpendicular to the longitudinal direction, wherein the holder member includes a supporting portion that cantilevers the blade member on a surface thereof such that the edge of the blade member protrudes toward the image carrier, and a bent portion that is connected to the supporting portion to form the L-shaped cross-section and is formed in such a manner that at least a lateral length at one end portion thereof in the longitudinal direction is shorter than a lateral length at a middle portion in the longitudinal direction.

2. A cleaning device comprising the cleaning blade according to claim 1.

3. The cleaning device according to claim 2, further comprising a conveying member that conveys non-transferred toner collected in the device in the longitudinal direction in order to discharge the non-transferred toner to the outside of the device, wherein the bent portion of the holder member is formed in such a manner that the lateral length at an end portion in the longitudinal direction corresponding to an upstream side in the conveying direction of the conveying member is shorter than the lateral length at other portions in the longitudinal direction.

4. The cleaning device according to claim 2, wherein the holder member includes a main reference portion and a sub reference portion, for positioning the cleaning blade with respect to the device, which are formed at both ends in the longitudinal direction so as to be set apart in the longitudinal direction, and the bent portion of the holder member is formed in such a manner that the lateral length at one end portion in the longitudinal direction where the main reference portion is formed is shorter than the lateral length at other portions in the longitudinal direction.

5. The cleaning device according to claim 2, wherein the bent portion of the holder member is formed in such a manner that the lateral length at an end portion thereof in the longitudinal direction corresponding to a side where a driving unit for driving the image carrier is formed is shorter than the lateral length at other portions in the longitudinal direction.

6. The cleaning device according to claim 2, further comprising a casing covering the cleaning blade is formed to follow the shape of the holder member.

7. A process cartridge that is removably provided to a main body of an image forming apparatus, wherein the cleaning device according to claim 2 is integrated with the image carrier.

8. An image forming apparatus comprising the cleaning device according to claim 2 and the image carrier.

9. A holder member for holding a cleaning blade which is provided in a cleaning device that removes non-transferred toner remaining on an image carrier, and in which an edge thereof is in contact with the image carrier over a longitudinal direction thereof, the holder member having an L-shape in a cross-section that is perpendicular to the longitudinal direction, comprising:

a supporting portion that cantilevers the blade member on a surface thereof such that the edge of the blade member protrudes toward the image carrier, and a bent portion that is connected to the supporting portion to form the L-shaped cross-section and is formed in such a manner that at least a lateral length at one end portion thereof in the longitudinal direction is shorter than a lateral length at a middle portion in the longitudinal direction.

* * * * *